US005489221A

United States Patent [19]

Fujiura et al.

[11] Patent Number: 5,489,221

[45] Date of Patent: Feb. 6, 1996

[54] ELECTRICAL CONNECTORS

[75] Inventors: Yoshitsugu Fujiura, Tokyo; Takeo Niwa, Kawasaki, both of Japan

[73] Assignee: The Whitaker Corporation, Wilmington, Del.

[21] Appl. No.: 195,230

[22] Filed: Feb. 14, 1994

[30] Foreign Application Priority Data

Apr. 9, 1993 [JP] Japan ..... 5-023816 U

[51] Int. Cl.[6] ..... H01R 13/40

[52] U.S. Cl. ..... 439/733.1; 439/869

[58] Field of Search ..... 439/83, 733, 736, 439/82, 444, 751, 869, 873

[56] References Cited

U.S. PATENT DOCUMENTS 3,897,131 7/1975 Stauffer ..... 439/733 X 4,941,847 7/1990 Welsh ..... 439/733 X 5,147,227 9/1992 Yurko ..... 439/82 X 5,346,413 9/1994 Leon et al. ..... 439/733

*Primary Examiner*—Khiem Nguyen

*Attorney, Agent, or Firm*—Adrian J. LaRue; Timothy J. Aberle

[57] ABSTRACT

The four corners of the pressure section (20) of the contact (10) punched out of a metal sheet are rounded off to form an oval surface (22). The lower portion (38) of the contact mounting opening (32) of the housing (30) is made of the same configuration as the pressure section (20). Since the dimensions of cross section of the lower portion (38) are made smaller than the corresponding dimensions of the pressure section (20), a tight joining is formed around the pressure section (20).

3 Claims, 3 Drawing Sheets

ELECTRICAL CONNECTORS

This invention relates to electrical connectors, especially to electrical connectors with contacts pressed into mounting openings made in an insulating housing of the connector where the contacts are intended for soldering to printed circuit boards.

BACKGROUND OF THE INVENTION

Solder flux is used for the purposes of activation of the solder and of improving its wetting properties. Since the fluxes have appropriate fluidity, they tend to penetrate, due to the capillary effect, inside the housing through-holes and into the spaces between the pressure sections of the contacts. The flux which penetrated into the contacting sections of the contacts may lead to deterioration of the contacting characteristics. Therefore, a number of techniques have been proposed for preventing the flux from penetration. These techniques can be divided into two large categories: one consisting of an increase in the gap between the press-in section of the contacts and the walls of the through-holes thereby reducing the capillary effect; and the other consisting of a tight sealing around the circumference of the press-in section of the contact.

FIG. 7 represents a plan cross-section of an example of the first technique (JP Patent No. (1991)-238719). The internal wall of the contact-mounting openings 102 of the housing 100 has curved pressure surface 104 of the same curvature as the internal curve 112 of the contact 110 made of a thin sheet. Boss 106 is provided to press the outer surface 114 of the contact 110 with the distance between the boss 106 and the pressure surface 104 being slightly smaller than the thickness of the sheet from which the contact 110 is made. The contact 110 does not form any capillary conduits with the walls of the contact-mounting opening 102, except for the area of the pressure surface 104 and the boss 106, thereby eliminating penetration of the flux.

FIG. 8 is a plan cross section illustrating the second type of measures against capillary effect. The pressure section 202 of the contact 200 stamped out of a metal sheet is of a rectangular shape, and it is pressed into the opening 212, which is slightly smaller than the pressure section of the housing 210. Since the pressure section 202 forms a tight seal along the entire perimeter of the opening 212, flux cannot penetrate between the internal walls of the opening and the pressure section 202.

However, in the first case, the gaps in the areas 120 adjacent to the boss 106 are very narrow, and the flux can penetrate through them by capillary effect. Other areas of possible flux penetration are shown in FIG. 7 by a dotted line; they appear if the contact 110 is placed off-center inside the contact-mounting opening 102, thereby making it possible for the flux to flow through the section 122 where the contact is closest to the side wall of the opening.

In the second type of configuration, the stamped contact may have various types of defects at the surface 204, such as rounded-off corners 206 as shown in FIG. 9. Additionally, unevenness 209 of the punched-out surface 208 can lead to the formation of capillary channels between the walls of the opening 212 and the contact surface thereby making it possible for the flux to penetrate to the tips of the contacts. It is possible to eliminate these channels by increasing-the interference between the contact and the opening. However, this can result in a considerably increased reaction in the housing concentrating in the corners of the opening 212 and leading to a formation of cracks 214. It is also possible to improve the quality of the contacts by stamping them from strips of a square cross section, but this method is applicable to only male post-type contacts.

Therefore, the purpose of this invention is to solve the above mentioned problems and to offer a connector free of the flux penetration due to the capillary effect in which no formation of cracks takes place in the housing and there is no limit on the type of contacts used in the connector.

SUMMARY OF THE INVENTION

The connectors according to this invention consist of a housing having at least one opening and at least one contact pressed in the above mentioned opening, characterized by the fact that the contacts are formed by being stamping out from a metal sheet with the above mentioned pressure section, and then are rounded off to form an oval. Additionally, the above mentioned openings are made of slightly smaller dimensions than the cross-section of the pressure section.

The flux penetration is completely prevented by forming a tight joining of the pressure section of the contacts along the entire perimeter of the mounting opening. The corners of the pressure section of the contacts are rounded off as well as the corners of the openings made in the housing, resulting in an even distribution of the reaction thereby preventing the formation of stress cracks. Since the rounding off of the corners of the pressure section can be accomplished during the stamping operation (including bending) any types of contacts can be used without the use of the strips of special profiles or special preliminary machining.

Below, we give detailed explanations concerning preferred embodiments of the connector according to this invention with reference to drawings. FIGS. 1 and 2 represent a contact used in an embodiment of a connector according to this invention. FIG. 1 is a front view and FIG. 2 is a side view. FIGS. 3–4 represent a housing used in an embodiment of a connector according to this invention, where FIG. 3 is a front cross-sectional view and FIG. 4 is a side cross-sectional view. FIGS. 5–6 show an embodiment of a connector according to this invention, where FIG. 5 is a front cross-sectional view, and FIG. 6 is a cross-section along 6—6 of FIG. 5.

BRIEF DESCRIPTION OF THE DRAWINGS

FIG. 1 shows a front view, and FIG. 2 shows a side view.

FIG. 3 shows a front cross-sectional view, and FIG. 4 show a side cross-sectional view.

FIG. 5 shows a front cross-sectional view, and FIG. 6 shows cross section taken along line 6—6 of FIG. 5.

DETAILED DESCRIPTION OF THE INVENTION

Figure 1:
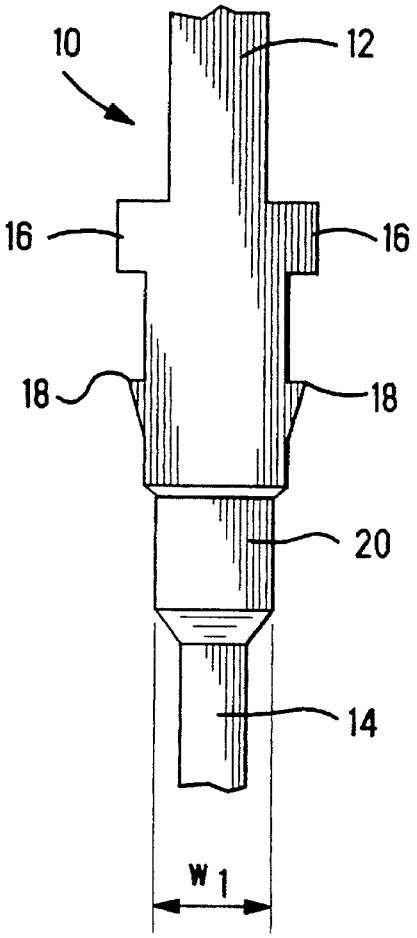
FIGS. 1 and 2 show the contact used in an embodiment of the connector according to this invention.
Figure 2:
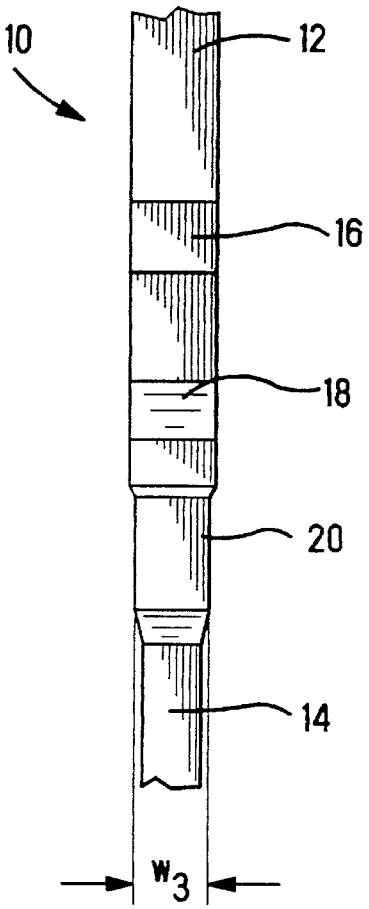
Figure 3:
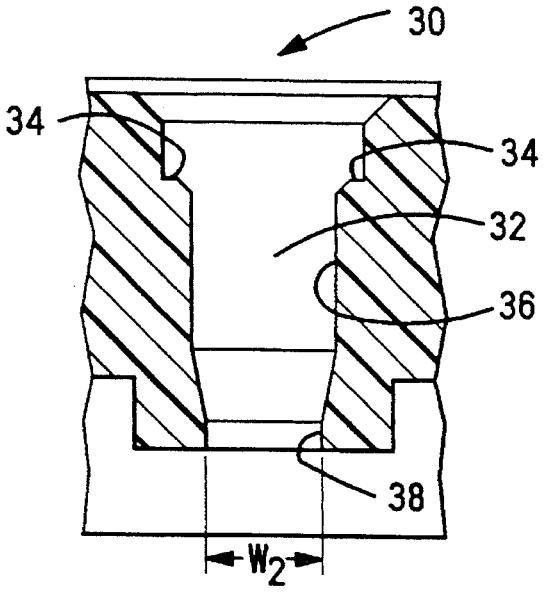
FIGS. 3 and 4 show the housing used in an embodiment of the connector according to this invention.
Figure 4:
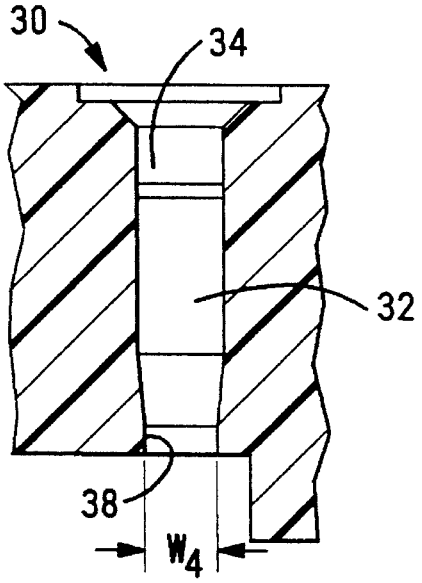
Figure 5:
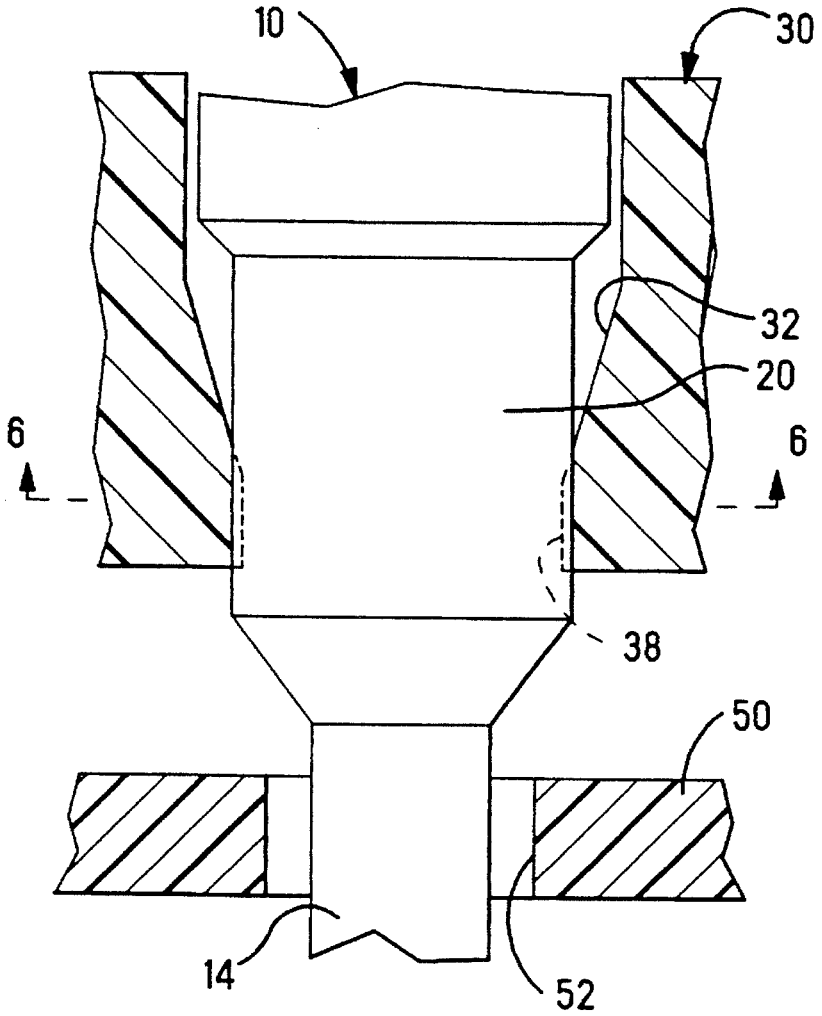
FIGS. 5 and 6 show an embodiment of the connector according to this invention.
Figure 6:
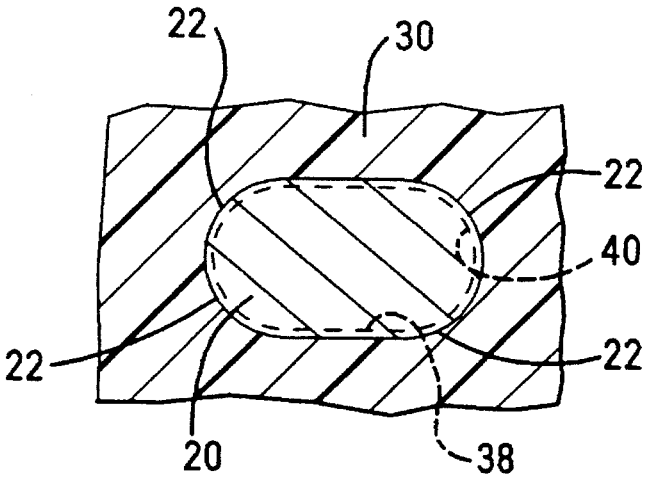
Figure 7:
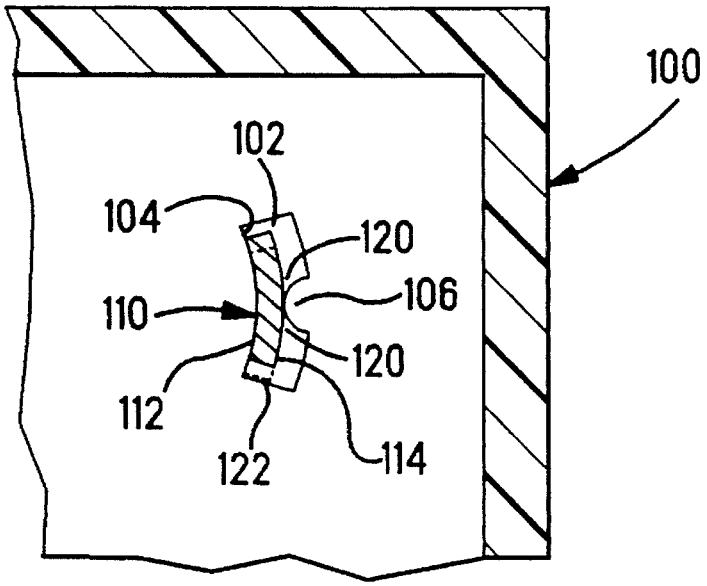
FIG. 7 shows a partially sectioned plan view of a conventional connector.
Figure 8:
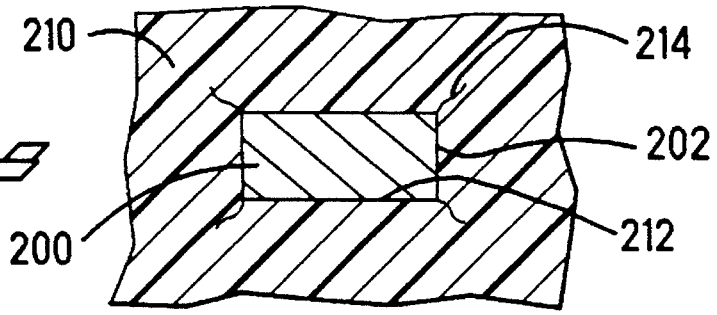
FIG. 8 shows a cross-sectional view of another type of conventional connector.
Figure 9:
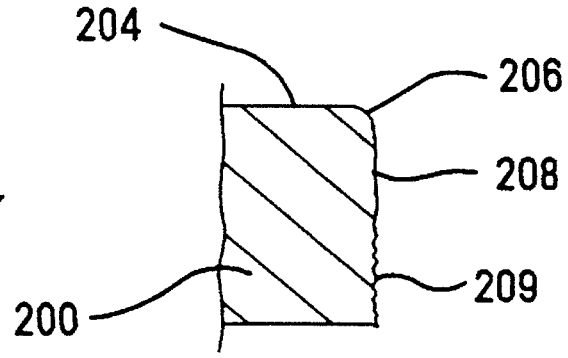
FIG. 9 shows an enlarged cross section of the contact of FIG. 8.

In FIGS. 1–4, a contact 10 is stamped from a brass or other copper-alloy sheet and has a tab-shaped connection section 12 at one end, and at the other end, a soldering tail section 14 in the form of a post which is passed through a through hole 52 of the base board 50 (FIGS. 5–6). The parts between the connection section 12 and the soldering tail section 14 are: stoppers 16, 16; engaging bosses 18, 18; and the pressure section 20. Stoppers 16, 16 determine a lower limit of the insertion of the contact 10 in the contact mounting opening 32 of the housing 30 by coming against the shoulders 34 made in the contact mounting opening 32. The engaging bosses 18, 18 prevent the contact from being pulled out from the above by cutting in the walls of the middle portion 36 of the contact mounting opening 32 of the housing 30. The pressure section 20 is pressed in the lower portion 38 of the contact mounting opening 32.

The relations between the contact 10 and the various parts of the housing 30 are as follows. The width $W_1$ of the pressure section 20 is slightly larger than the width of the lower portion 38 of the opening $W_2$. The depth $W_3$ of the pressure section 20 is slightly larger than the depth $W_4$ of the lower portion 38 of the opening. Since the width and depth of the middle portion 36 are larger than the width and depth $W_1$ and $W_3$ of the pressure section 20, the latter can be passed through the middle portion 36 without interference until it reaches the lower portion 38.

As one can see from FIG. 6, corners of the pressure section are rounded off at 22, 22, 22, 22, which can be accomplished during the stamping of the contact 10. During the stamping operation, the unevenness of the punched out surface can be smoothed by the pressure from the punch and die. The dotted line outlines the configuration of the lower portion 38 of the contact mounting opening 32 prior to the insertion of the contact 10. In FIG. 6, one can see that the lower portion 38 (shown by the dotted line) is made in such a way that it has rounded sections 40 of radii smaller than those of rounded off corners 22 of the pressure section 20. Since as was mentioned above, the dimensions of the pressure section 20 are larger than the corresponding dimensions of the lower portion 38 of the contact mounting opening, the perimeter of the pressure section 20 will form a tight joining with the lower portion 38. Therefore, the penetration of the flux through the soldering tail section 14 and the through holes 52 of the base board 50 will be completely eliminated. In addition, since the height of the lower portion 38 is relatively small, the resistance developed due to the interference between the pressure section 20 and the lower portion 38 is relatively low. Since the perimeter of the lower portion 38 has rounded ends 40, the reaction generated in the housing 30 by the insertion of the contact 10 is dispersed, thereby preventing stress crack formation. The cross sections of the pressure section 20 and the lower portion 38 are elliptical, which serves to the purpose of a proper alignment of the contact 10.

Above, we gave explanations concerning a preferred embodiment of the connector according to this invention; however the invention is not limited to this embodiment only and covers various configurations and modifications made because of practical requirements. For example, the contacting section may be made as a female contact, and the soldering tale sections can be made of either DIP or SMT type. The cross section of the pressure section of the contact and the insertion opening can be made of either oval or elliptical shape. Moreover, the term "oval" used in this specification does not necessarily mean a straight oval, but also various configurations of a generally oval form.

Based on this invention, we can offer a connector with pressure-type contacts which is free of cracks in the housing resulting from the insertion of the contacts, thereby eliminating penetration of the flux. Contacts used in these connectors are not limited to the male-type contacts only, but include all types of contacts which can be made by stamping from a metal sheet.

We claim:

1. An electrical connector comprising an insulating housing having at least one opening;

a contact pressed into said opening that is generally flat by stamping a metal plate and includes a soldering tail section, a pressure section with corners being rounded off to provide a generally oval cross section, a retention section and a connection section; and said opening in the housing being profiled to have a slightly smaller dimension than said pressure section at the end closer to the soldering tail section, thereby substantially eliminating any gap between said opening and said pressure section when the contact is fully inserted into said opening.

2. An electrical connector of claim 1, wherein said retention section of the contact is formed with engaging bosses and stoppers at both sides.

3. An electrical connector of claim 1, wherein said soldering tail section of the contact is narrower and thinner than said pressure section.

* * * * *